United States Patent [19]

Brandriff

[11] 4,017,909

[45] Apr. 19, 1977

[54] DISPOSABLE OPERATING ROOM GOWN

[76] Inventor: Robert Brandriff, 19472 Country Club Drive, Tequesta, Fla. 33458

[22] Filed: Oct. 3, 1975

[21] Appl. No.: 619,248

[52] U.S. Cl. ..... 2/114; 2/DIG. 7

[51] Int. Cl.[2] ..... A41D 13/00

[58] Field of Search ..... 2/46, 48, 49 R, 51, 2/59, 69, 69.5, 74, 83, 87, 108, 114, 243 R, 243 B, DIG. 7

[56] References Cited

UNITED STATES PATENTS

| | | | |
|---|---|---|---|
| 2,668,294 | 2/1954 | Gilpin | 2/114 |
| 3,574,864 | 4/1971 | Bradley | 2/114 |
| 3,721,998 | 3/1973 | Meyers | 2/114 X |
| 3,721,999 | 3/1973 | Goya et al. | 2/114 |
| 3,868,728 | 3/1975 | Krzewinski | 2/114 |
| 3,911,499 | 10/1975 | Benevento et al. | 2/114 |

FOREIGN PATENTS OR APPLICATIONS

| | | | |
|---|---|---|---|
| 248,891 | 2/1961 | Australia | 2/114 |

*Primary Examiner*—Werner H. Schroeder
*Assistant Examiner*—Moshe I. Cohen
*Attorney, Agent, or Firm*—Lane, Aitken, Dunner & Ziems

[57] ABSTRACT

A surgical gown is formed of a front panel of a single section of material which has two sleeves with the front portion of each one integral with the front panel so that no seams are located at the front of the gown. Each sleeve is formed of a single section of material which is folded and joined by a seam located along the upper edge of the sleeve. The gown further includes a back portion joined to the front panel and sleeves.

15 Claims, 6 Drawing Figures

DISPOSABLE OPERATING ROOM GOWN

BACKGROUND OF THE INVENTION

This invention relates to surgical operating room gowns and, more specifically, to surgical gowns which are disposable after use.

Hospital operating room personnel wear sterile gowns as a barrier to protect patients from infection by preventing bacteria on the skin or clothes of the personnel from coming in contact with the patient. These gowns also operate to prevent operating room instruments and equipment from becoming contaminated and to protect the wearer from blood and other fluids.

In the past these gowns were formed of a cloth such as linen and were washed and sterilized between uses. More recently, however, it has become economically advantageous to use disposable gowns and then discard them after each use.

Disposable gowns are typically formed similar to the way non-disposable gowns are formed, with the main difference being that they are made from non-woven inexpensive plastic or paper materials. It has been found that one disadvantage of these disposable gowns is that seams along which different panels are joined are not as tight as they should be, which often results in the seam being broken. In addition, the use of a single material for the entire gown is not always desirable because, while the front should preferably be fluid resistant, the back need not be and could be ventilated to provide for air circulation beneath the gown. In addition, while automated methods used for preforming such gowns have simplified gown design for greater assembly efficiency, the fit and style of the gown have been sacrificed.

SUMMARY OF THE INVENTION

The problems mentioned above have been solved by providing a disposable surgical gown of the construction discussed below and by providing a number of specially shaped, separate, pre-cut panels which can be joined together to form such a disposable gown.

The gown can be formed of any suitable material and because of the construction of it, as will be described in detail below, different types of materials can be used in the same gown, such as for example a fluid impervious or liquid repellant material for the front and sleeves and a breathable or ventilated fabric for the back. The gown is formed of a plurality of separately cut panels which are shaped and dimensioned such that there are no seams or places where different panels are joined in the front or along the lower part of the sleeves. This feature minimizes the possibility of fluid leakage or contamination through broken seams.

In addition, because of the shape of the panels and the way they are fitted together unrestricted shoulder motion is available and a better fit around the waist is provided. Although a simple two-dimensional closure assembly technique is used, the gown provides ample shoulder room.

A pocket and integrally formed belt can easily be attached to the sides of the gown during assembly. Another feature is that the high stress area normally found under the arm of the user can easily be reinforced and the neck edge and cuffs can be lined with a soft, nonabrasive material to prevent chafing of the skin. By using a continuous web method of laying out the pattern, as is described below, it is easy to overlay and attach to a base layer additional laminations of fluid impervious or other types of coatings that can be sealable to the base layer. A closure means can be attached at the rear neck opening in order to keep the gown closed.

BRIEF DESCRIPTION OF THE DRAWINGS

For a better understanding of the invention, reference may be had to the following description of an exemplary embodiment, taken in conjunction with the accompanying drawings, in which.

DETAILED DESCRIPTION OF AN EXEMPLARY EMBODIMENT

An exemplary embodiment of the disposable surgical gown and the panels from which the gown is formed is described below in detail.

Figure 1:
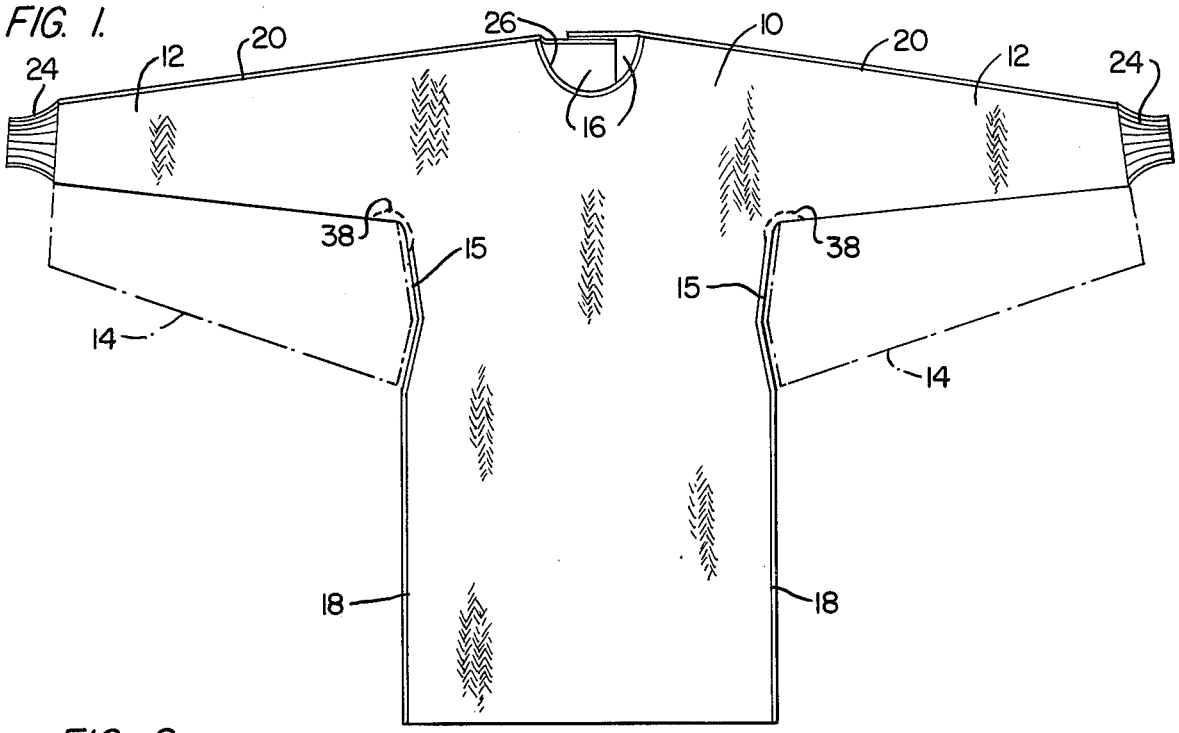
FIG. 1 is a front view of an assembled disposable surgical gown and shows by means of broken lines the originally cut shape of the front panel before the sleeves are formed.

As shown best in FIG. 1, an important feature of the disposable gown is that the front of the gown does not include any seams along which different portions of the gown are joined together. In addition, there are no seams on the front or lower part of the sleeves.

As shown in FIG. 1, the front of the gown is formed of a panel designated generally by reference numeral 10. The front portions of a pair of sleeves 12 are integral with the front panel 10. The back portions of the sleeves in their unassembled form are shown by the broken lines 14 and are separated from the front panel 10 by cutting along the lines designated by reference numeral 15. This shape enables the sleeves 12 to be assembled (as will be described below) without requiring any seams to be located in the front or bottom portion of the sleeves and provides for a sleeve shape so that there is enough shoulder room for the wearer. In addition, the cut 15 also provides a contoured shape around the waist of the gown for a better fit.

The front panel 10 can be formed of any suitable flexible material, such as special paper or plastic, which combines the features of being fluid impervious and inexpensive enough to be disposable.

Figure 2:
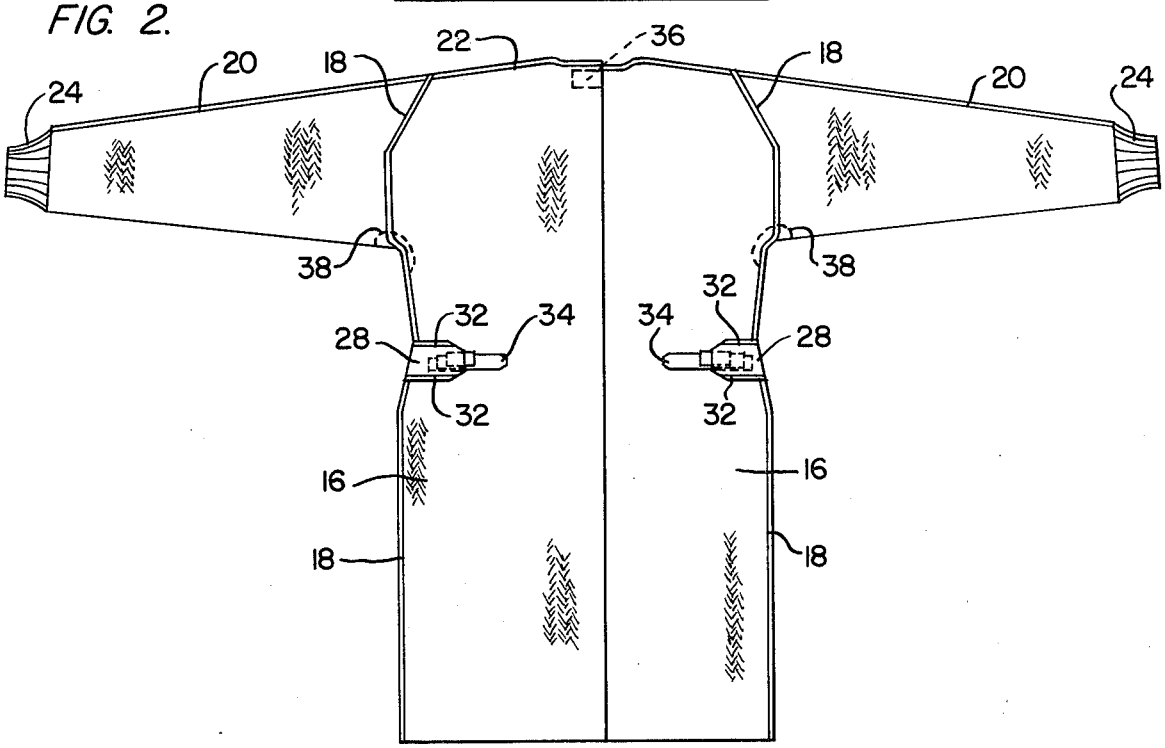
FIG. 2 is a rear view of the gown and shows in particular the shape and relative positions of the two back panels which are connected to the single front panel.

As best shown in FIG. 2, the back of the gown is formed of two separate back panels 16 which can be formed of a material different from that used for the front panel 10 such as, for example, a material which allows air to circulate through the panels.

It will be noticed that the front and back panels are contoured to provide a reasonably good fit for the wearer. This contoured fit can easily be provided by forming the back portions of the sleeves 12 as shown by the broken lines 14 in FIG. 1. This shape also provides for ample shoulder room and allows the gown to easily be assembled.

Figure 3A:
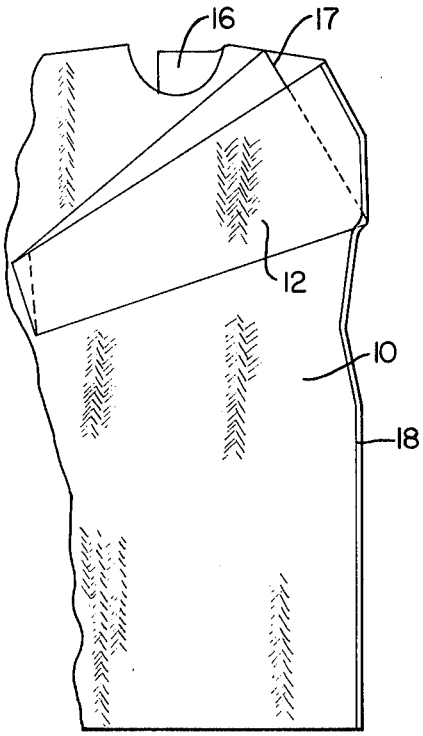
FIGS. 3A and 3B are front views of a portion of the gown and show in particular how the seams which join the front and back panels are formed.
Figure 3B:
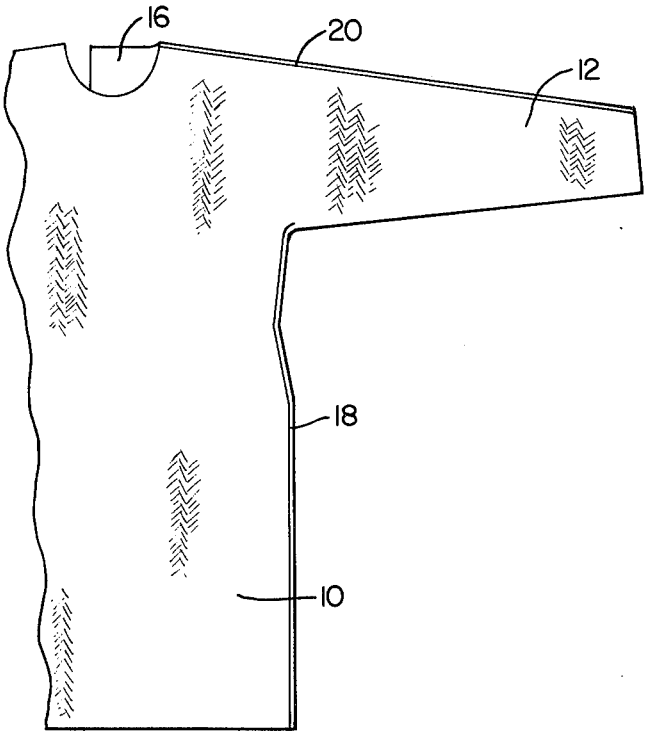

The technique for assemblying the gown is best shown in FIGS. 3A and 3B. By shaping the front and back panels as described above, a simple procedure of forming two-dimensional seams for joining the panels on each side of the gown can be used and still provide ample shoulder room and a contoured fit. First, as shown in FIG. 3A, the back portion of the sleeve 12 designated by the broken lines 14 in FIG. 1 is folded upward along its length to form the sleeve 12. The sleeve 12 is then folded across the front panel 10 while the front and back panels are aligned. It will be noticed that the front portion of the sleeve 12 is offset relative to the back portion and folded along the line designated by reference numeral 17. The seam 18 is then formed along the entire vertical dimension of the gown to join the front panel 10 and the back portion of the sleeve 12 to the back panel 16.

It should be noted that the seam 18, as well as all other seams in the gown, can be formed by heat sealing, using an adhesive or stitching or by any other suitable techniques.

After the side seam 18 is formed, the sleeve 12 is straightened out as shown in FIG. 3B and the seam 20 is formed along the top edge of the sleeve 12 and the portion of the gown which fits over the shoulder. The same procedure is then followed for the other side of the gown. Alternatively, both side seams 18 can be formed first, followed by formation of both top seams 20.

Figure 4:
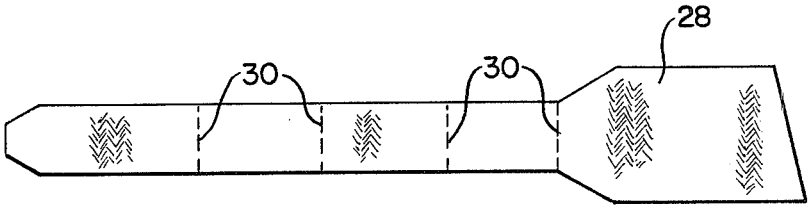
FIG. 4 shows the shape of the panel that is used to form one of the waist belts.

Cuffs 24 formed of any suitable material such as an elastic fabric which does not have a tendency to chafe the wrists can be provided on the outer ends of the sleeves 12. A piece of material can be provided around the neck 26, such as tape of a soft, nonabrasive material to prevent chafing of the wearer's neck. A pair of belts 28 can be attached at each side of the gown, as shown in FIG. 2, the panels used to form the belts 28 having the shape shown in FIG. 4. These belts can be folded in accordion-like fashion along the dotted lines 30 and sealed to the gown as indicated by the dotted lines 32 in FIG. 2 to form a pocket into which the folded portion of the belt can be stored so that the belts 28 can easily be tied by simply pulling the exposed ends 34 which project out of the pocket.

A closure means 36 can be provided at the rear neck opening of the gown, which can be formed of VELCRO, snaps, tie strings or adhesive tape in order to join the two back panels together.

In addition, in order to reinforce the armpit area of the gown, a semi-circular stitched seam, shown by the dotted line 38 in FIGS. 1 and 2, can be provided. In this way, the gown is reinforced in the high stress area of the underarm to reduce the possibility of seam failure there.

As mentioned above, the front panel 10 of the gown can be formed of any type of fluid impervious material which lends itself to the disposability feature of the surgical gown. The back, on the other hand, can be formed of any suitable material which provides air circulation therethrough for greater comfort of the user.

Figure 5:
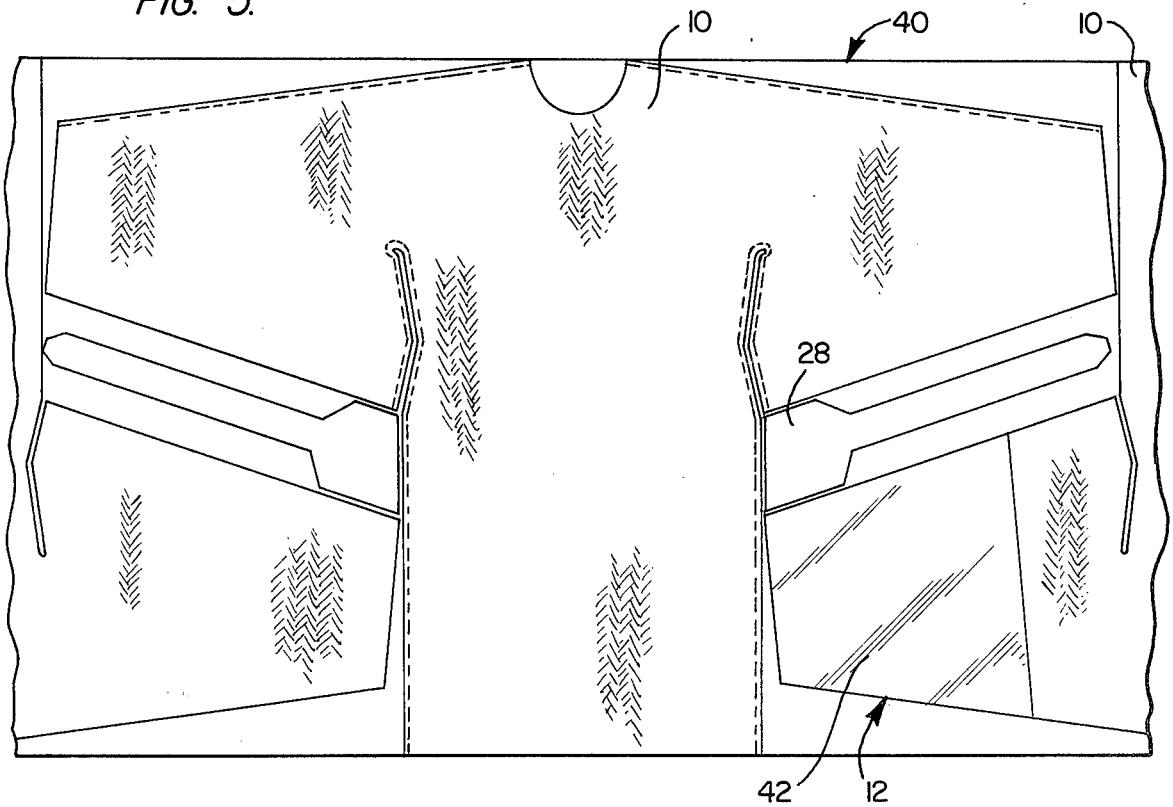
FIG. 5 shows a portion of the web of material from which the front panels that are used to form the gown are outlined, showing in particular a typical layout of such panels.

FIG. 5 shows a typical pattern layout which can be used for obtaining maximum use of the fabric. In FIG. 5, the web of suitable material 40 has been printed with the outline of the front panels 10 and the belts 28 in such a manner as to provide for minimum waste. The back panels can be formed the same way on a web of a different material. It will also be noted that an advantage of forming the disposable gowns of the panels as discussed above and laying them out on the web of material such as the one shown in FIG. 5 allows portions of the gown to be reinforced or formed in laminated fashion to provide fluid impervious coatings or extra strength. This feature is shown by the hatched lines 42 which indicate that an overlay of a fluid impervious coating has been made on the arm portion 12 of the front panel 10. This overlay can be formed by using pressure sensitive adhesive or by heat sealing or other suitable means. In this way material is saved by only making selected portions of the gowns heat sealable or fluid impervious.

Thus, a disposable surgical gown is provided which has distinct advantages of being inexpensive to manufacture and which can easily be shaped to conform to the user's contours. In addition, the panels are shaped and dimensioned such that a minimum number of seams are required in order to attach all of the panels to each other to form the final gown. The final product is one that is comfortable to wear because it can be shaped properly and ventilated in the back and also provide the features of being strong enough to prevent contamination while still being inexpensive enough to be disposable.

The embodiments of the invention described above are intended to be merely exemplary, and those skilled in the art will be able to make modifications and variations are contemplated as falling within the scope of the appended claims.

I claim:

1. A surgical gown, comprising a front panel formed of a single section of material, two sleeves with the front portion of each one integral with the front panel so that no seams are located at the front of the gown, each sleeve being formed of said single section of material which is folded and joined by a seam located along the upper edge of the sleeve so that no seams are located in the front or bottom portions thereof, the gown further including a back portion joined to the front panel and sleeves.

2. The gown in claim 1, wherein the back portion is formed of two back panels.

3. The gown in claim 2, and further including closure means for selectively maintaining the upper portion of the back panels in a closed position.

4. The gown in claim 2, and further including belt means for tightening the gown around the waist of the wearer.

5. The gown in claim 4, wherein the belt means includes a belt section connected at both sides of the gown, each belt section formed of a single length of material which includes a tab portion adapted to be connected to a back panel and form a pocket therein and a belt portion adapted to be removably folded in said pocket.

6. The gown in claim 1, wherein the front panel and back portion of the gown are joined along each side of the gown by a seam which extends along the full vertical length of the gown and across the back of the sleeves.

7. The gown in claim 1, wherein the seam located along the upper edge of the sleeve extends to join the front panel and back portion along the upper edges thereof.

8. The gown in claim 1, wherein the front panel and sleeves are fluid impervious.

9. The gown in claim 1, wherein the back portion is formed of material which allows air to pass therethrough.

10. Preformed panels adapted to be joined together to form a surgical gown, comprising a front panel formed of a single section of material, a pair of sleeve panels with the portion of each one located at the front of the gown being formed integrally with the front panel so that no seams will be located at the front of the gown when joining said panels the sleeve panels being shaped and dimensioned so that sleeves will be formed by folding said sleeve panels lengthwise and forming a seam along the upper edge of the sleeve when each sleeve panel is joined to form a sleeve, a back adapted to be joined to the front panel and sleeve panels.

11. The panels in claim 10, wherein the back is formed of two back panels adapted to be joined to the front and sleeve panels by a seam which extends along the full vertical length and across the back of the sleeves on each side of the gown.

12. The panels in claim 11, wherein the back panels are adapted to be joined to the front and sleeve panels by a seam located along the upper edges thereof which is an extension of the seam along the upper edge of the sleeves.

13. Method for making a surgical gown comprising the steps of:

1. preforming a front panel of a single section of material with a sleeve section having a front portion integral with the front panel and a back portion integral with the front portion along the length of the sleeve section;
2. folding the sleeve section lengthwise so that the back portion overlays the front portion and the fold extends along the lower edge of the sleeve;
3. aligning the front panel with a back panel and folding the sleeve section over the front panel such that front portion is offset relative to the back portion;
4. forming a seam along the vertical length of the gown for joining the front panel and back portion of the sleeve section to the back panel;
5. unfolding the sleeve section away from the front panel and aligning the front and back portions;
6. forming a seam along the top edge of the sleeve section and the front and back panels for forming a sleeve and joining the front and back panels at the top thereof.

14. The method in claim 13, and further including the step of forming a reinforcing seam in the armpit area of the gown.

15. The method in claim 13, and futher including the step of forming a belt by folding a length of material under a tab portion and connecting the tab portion to the back panel such that the length of material can be pulled therefrom.

* * * * *